US006516298B1

(12) United States Patent
Kamai et al.

(10) Patent No.: US 6,516,298 B1
(45) Date of Patent: Feb. 4, 2003

(54) SYSTEM AND METHOD FOR SYNTHESIZING MULTIPLEXED SPEECH AND TEXT AT A RECEIVING TERMINAL

(75) Inventors: Takahiro Kamai, Kyoto (JP); Kenji Matsui, Ikoma (JP); Zhu Weizhong, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/550,891

(22) Filed: Apr. 17, 2000

(30) Foreign Application Priority Data

Apr. 16, 1999 (JP) ..... 11-109329

(51) Int. Cl.[7] ..... G10L 13/00
(52) U.S. Cl. ..... 704/260; 704/270
(58) Field of Search ..... 704/260, 219, 704/262, 270

(56) References Cited

U.S. PATENT DOCUMENTS 3,704,345 A * 11/1972 Coker et al. ..... 704/260
5,905,972 A * 5/1999 Huang et al. ..... 704/268
6,226,614 B1 * 5/2001 Mizuno et al. ..... 704/260
6,334,106 B1 * 12/2001 Mizuno et al. ..... 704/260

OTHER PUBLICATIONS

Beckman, Mary E. et al. "Guidelines for ToBI Labelling", (version 3, Mar. 1997), The Ohio State University Research Foundation, pp. 1–134, copyright (1993).

* cited by examiner

*Primary Examiner*—Susan McFadden
(74) *Attorney, Agent, or Firm*—RatnerPrestia

(57) ABSTRACT

The reception terminal receives a code series from the communication path. The separator separates the code series into a speech code series and text information. The speech code series is decoded into a pitch period, a LSP coefficient, and code numerals by the synthesizer to reproduce the speech sound in the CELP system. Also, the text information is converted into pronunciation and accent information by the language analyzer and added to prosody information, such as phoneme time length and pitch pattern by the prosody generator. The LSP coefficient, and code numerals suitable for the phoneme are read from the segment database and the pitch frequency from the prosody information is inputted to the synthesizer and synthesized into speech sound.

16 Claims, 14 Drawing Sheets

Fig. 8 (a)

| | |
|---|---|
| input | 今日は、いい天気です。 |
| output | kyo' o wa , i' i / te' N ki de su . |

Fig. 8 (b)

| | |
|---|---|
| input | It's fine today. |
| output | 2ih t s - f lay n - t ax - d ley . |

Fig. 8 (c)

| | |
|---|---|
| input | 今天是晴天 |
| output | jin1 tian1 shi4 qing2 tian1 |

Fig. 10

| mora number | accent type | first mora | second mora | third mora | fourth mora | fifth mora |
|---|---|---|---|---|---|---|
| 1 | 0 | *248* | | | | |
| 1 | 1 | *328* | | | | |
| 2 | 0 | *247* | *333* | | | |
| 2 | 1 | *340* | *174* | | | |
| 3 | 0 | *247* | *333* | *298* | | |
| 3 | 1 | *358* | *285* | *183* | | |
| 3 | 2 | *273* | *364* | *171* | | |
| 4 | 0 | *288* | *357* | *329* | *283* | |
| 4 | 1 | *366* | *342* | *237* | *174* | |
| 4 | 2 | *245* | *376* | *239* | *173* | |
| 4 | 3 | *244* | *357* | *338* | *185* | |
| 5 | 0 | *250* | *330* | *320* | *300* | *287* |
| 5 | 1 | *350* | *240* | *218* | *199* | *173* |

| mora number | first mora | second mora | third mora | fourth mora | fifth mora |
|---|---|---|---|---|---|
| 1 | 180 | | | | |
| 2 | 130 | 170 | | | |
| 3 | 140 | 160 | 165 | | |
| 4 | 140 | 160 | 165 | 160 | |
| 5 | 130 | 155 | 160 | 155 | 150 |

Fig. 11

Fig. 12 input kyo' o wa , i1 i / te1' N ki de su.

output

| phonetic transcription | kyo | o | wa | SIL | i | i | te | N | ki | de | su | SIL |
|---|---|---|---|---|---|---|---|---|---|---|---|---|
| time length | *140* | *160* | *165* | *200* | *130* | *170* | *130* | *155* | *160* | *155* | *150* | *200* |
| pitch | *358* | *285* | *183* | *0* | *340* | *174* | *350* | *240* | *218* | *199* | *173* | *0* |

Fig. 13 input

| phonetic transcription | kyo | o | wa | SIL | i | i | te | N | ki | de | su | SIL |
|---|---|---|---|---|---|---|---|---|---|---|---|---|
| time length | 140 | 160 | 165 | 200 | 130 | 170 | 130 | 155 | 160 | 155 | 150 | 200 |
| pitch | 358 | 285 | 183 | 0 | 340 | 174 | 350 | 240 | 218 | 199 | 173 | 0 |

processing result

| phonetic transcription | kyo | o | wa | SIL | i | i | te | N | ki | de | su | SIL |
|---|---|---|---|---|---|---|---|---|---|---|---|---|
| time length | 126 | 144 | 149 | 180 | 117 | 153 | 117 | 140 | 144 | 140 | 135 | 180 |
| pitch | 430 | 342 | 220 | 0 | 408 | 209 | 420 | 288 | 262 | 239 | 208 | 0 |

SYSTEM AND METHOD FOR SYNTHESIZING MULTIPLEXED SPEECH AND TEXT AT A RECEIVING TERMINAL

BACKGROUND OF THE INVENTION

1. Technical Field of the Invention

The present invention relates to a method for carrying out information transmission by using speech sounds on a portable telephone, Internet or the like.

2. Description of the Related Art

Speech sound communication systems are constructed by connecting transmitters and receivers via wire communication paths such as coaxial cables or radio communication paths such as electromagnetic waves. Though, in the past analog communications were the mainstream where acoustic signals are propagated directly or by being modulated into carrier waves on those communication paths, digital communications have been becoming mainstream where acoustic signals are propagated after being coded once for the purpose of increasing communication-quality with respect to anti-noise properties or distortion and increasing the number of communication channels.

Recent communications systems, such as portable telephones, use the CELP (Schroeder M. R. and Atal B. S.: "Code-Excited Linear Prediction (CELP): High-Quality Speech at Very Low Bit Rates," Pros. IEEE ICASSP '85, 25.1.1, (April 1985)) system to correct the deficiencies of transmission radio wave bands caused by the rapid spread of such communications systems.

FIG. 7 shows an exemplary configuration example of the CELP speech coding and decoding system.

The processing on the coding end, that is, on the transmission terminals end is as follows. Speech sound signals are processed by partition into frames of, for example, 10 ms or the like. The inputted speech sounds undergo LPC (Linear Prediction Coding) analysis at the LPC analysis part 200 to be converted to a LPC coefficient $\alpha_i$ representing a vocal tract transmission function.

The LPC coefficient $\alpha_i$ is converted and quantized to a LSP (Line Spectrum Pair) coefficient $\alpha_{qi}$ at an LSP parameter quantization part 201. $\alpha_{qi}$ is given to a synthesizing filter 202 to synthesize a speech sound wave form by a voicing wave form source read out from an adaptive code book 203 corresponding to a code number $c_a$. The speech sound wave form is inputted as a periodic wave form in accordance with a pitch period $T_0$ calculated out by using an auto-correlation method or the like in parallel with the previous processing.

The synthesized speech sound wave form is subtracted from the inputted speech sound to be inputted into a distortion calculation part 207 via an auditory weighting filter 206. The distortion calculation part 207 calculates out the energy of the difference between the synthetic wave form and the inputted wave form repetitively while changing the code number $c_a$ for the adaptive code book 203 and determines the code number $c_a$ that makes the energy value the minimum.

Then the voicing source wave form read out under the determined $c_a$ and the noise source wave form read out according to the code number $c_r$ from the noise code book 204 are added to determine the code number $c_r$ that makes the distortion minimum following similar processing. The gain values are also determined which are to be added to both voicing source and noise source wave forms through-the previously accomplished processing so that the most suitable gain vector corresponding to them is selected from the gain code book to determine the code number $c_g$.

The LSP coefficient $\alpha_{qi}$, the pitch period $T_0$, the adaptive code number $c_a$, the noise code number $c_r$, the gain code number $c_g$ which have been determined as described above are collected into one data series to be transmitted on the communication path.

On the other hand, the processing on the decoding end, that is, on the reception terminal end, is as follows.

The data series received from the communication path is again divided into the LSP coefficient $\alpha_{qi}$, the pitch period $T_0$, the adaptive code number $c_a$, the noise code number $c_r$, and the gain code number $c_g$. The periodic voicing source is read out from the adaptive code book 208 in accordance with the pitch period $T_0$ and the adaptive code number $c_a$, and the noise source wave form is read out from the noise code book 209 in accordance with the noise code number $c_r$.

Each voicing source receives an amplitude adjustment by the gain represented by the gain vector read out from the gain code book 210 in accordance with the gain code number $c_g$ to be inputted into the synthesizing filter 211. The synthesizing filter 211 synthesizes speech sound in accordance with the LSP coefficient $\alpha_{qi}$.

The speech sound communication system as described above has the main purpose of propagating speech sound efficiently with a limited communication path capacitance by compression coding inputted speech sound. That is to say the communication object is solely speech sound emitted by human beings.

Today's communications services, however, are not limited to only speech sound communications between human beings in distant locations but services such as e-mail or short messages are becoming widely used where data are transmitted to a remote reception terminal by inputting text utilizing transmission terminals. And it has become important to provide speech sound from apparatuses to human beings such as those supplying a variety of information by speech sound represented by the CTI (Computer Telephony Integration) or providing operating methods of the apparatuses in speech sound. Moreover, by using the speech sound rule synthesizing technology which converts text information into speech sound it has become possible to listen to the contents of e-mails, news or the like on the phone, which has been attracting attention recently.

In this way it has been required to have a communication service form to convert text information into speech sound. The following two forms are considered as methods to implement those services.

One is a method for transmitting speech sound synthesized on the. service supplying end to the users by using normal speech sound transmissions. In the case of this method the terminal apparatuses on the reception end only receive and reproduce the speech sound signals in the same way as the prior art and common hardware can be used.

Vocalizing a large amount of text, however, means to keep speech sounds flowing for a long period of time into the communication path and in the case of using communication systems such as portable telephones it becomes necessary to maintain the connection for a long period of time. Accordingly, there is the problem that communication charges becomes too expensive.

The other is a method for letting the users hear the speech sound converted by a speech sound synthesizing apparatus of the reception terminals after the information is transmitted on the communication path in the form of text. In the case of this method the information transmission amount is an extremely small amount such as one several hundredths of a speech sound which makes it possible to be transmitted in a very short period of time. Accordingly, the communication charges are held low and it becomes possible for the user to listen to the information by conversion into speech sounds whenever desired if the text is stored in the reception terminal. There is also an advantage that different types of voices such as male or female, speech rates, high pitch or low pitch or the like can be selected at the time of conversion to speech sounds.

The speech sound synthesizing apparatus to be installed as a terminal apparatus on the reception end, however, has different circuits from that used as an ordinary reception terminal such as a portable telephone, therefore, new circuits for synthesizing speech sounds should be mounted, which leads to the problem that the circuit scale is increased and the cost for the terminal apparatus is increased.

SUMMARY OF THE INVENTION

Considering such a conventional problem of the communication method, it is the purpose of the present invention to provide a speech sound communication system which has a smaller communication burden and has a simpler speech synthesizing apparatus on the reception end.

To solve the above described problems the present invention provides a speech sound communication apparatus.

One aspect of the present invention is a speech sound communication system comprising;

a transmission part having a text input means and a transmission means;

a reception part having a reception means, a language analysis means, a prosody generation means, an segment data memory means, an segment read-out means and a synthesizing means, wherein, said text input means inputs text information;

said transmission means transmits said text information to a communication path;

said reception means receives said text information from said communication path;

said language analysis means analyses said text information so that said text information is converted to phonetic transcription information;

said prosody generation means converts said phonetic transcription information into phonetic transcription with prosody information on which the prosody information is added;

said segment read-out means reads out segment data from said segment data memory means in accordance with said phonetic transcription information with prosody information;

said synthesizing means synthesizes a speech sound by utilizing said phonetic transcription information with prosody information and said segment data;

said segment data memory means stores voicing source characteristics and vocal tract transmission characteristics information; and said synthesizing part synthesizes speech sound by generating a voicing source wave form having a period in accordance with said prosody information and having characteristics in accordance with said voicing source characteristics and by filter processing said voicing source wave form in accordance with said vocal tract transmission characteristics information.

Another aspect of the present invention is a speech sound communication system comprising a transmission part having a text input means, a language analysis means and a transmission means as well as a reception part having a reception means, a prosody generation means, an segment data memory means, an segment read-out means and a synthesizing means, wherein, said text input means inputs text information;

said language analysis means converts said text information into phonetic transcription information;

said transmission means transmits said phonetic transcription information into a communication path;

said reception means receives said phonetic transcription information from said communication path;

said prosody generation means converts said phonetic transcription information into phonetic transcription information with prosody information;

said segment readout means reads out segment data from said segment data memory means in accordance with said phonetic transcription information with prosody information;

said synthesizing means synthesizes a speech sound by utilizing said phonetic transcription information with prosody information and said segment data;

said segment data memory means stores voicing source characteristics and vocal tract transmission characteristics information; and said synthesizing means synthesizes speech sound by generating a voicing source wave form having a period in accordance with said prosody information and having characteristics in accordance with said voicing source characteristics and by filter processing said voicing source wave form in accordance with said vocal tract transmission characteristics information.

Still another aspect of the present invention is a spech sound communication system comprising a transmission part having a text input means, a language analysis means, a prosody generation means and a transmission means as well as a reception part having a reception means, an segment data memory means, an segment read-out means and a synthesizing means, wherein, said text input means inputs text information;

said language analysis means converts said text information into phonetic transcription information;

said prosody generation means converts said phonetic transcription information into phonetic transcription information with prosody information;

said transmission means transmits said phonetic transcription information with prosody information into a communication path;

said reception means receives said phonetic transcription information with prosody information from said communication path;

said segment read-out means reads out segment data from said segment data memory means in accordance with said phonetic transcription information with prosody information;

said synthesizing means synthesizes a speech sound by utilizing said phonetic transcription information with prosody information and said segment data;

said segment data memory means stores voicing source characteristics and vocal tract transmission characteristics information; and said synthesizing part synthesizes speech sound by generating a voicing source wave form having a period in accordance with said prosody information and having characteristics in accordance with said voicing source characteristics and by filter processing said voicing source wave form in accordance with said vocal tract transmission characteristics information.

Yet another aspect of the present invention is a speech sound communication system comprising:

a transmission part having a text input means and a first transmission means;

a repeater part having a first reception means, a language analysis means and a second transmission means; and a reception part having a second reception means, a prosody generation means, an segment data memory means, an segment read-out means and a synthesizing means;

wherein, said text input means inputs text information;

said first transmission means transmits said text information to a first communication path;

said first reception means receives said text information from said first communication path;

said language analysis means converts said text information into phonetic transcription information;

said second transmission means transmits said phonetic transcription information into a second communication path;

said second reception means receives said phonetic transcription information from said second communication path;

said prosody generation means converts said phonetic transcription information into phonetic transcription information with prosody information;

said segment read-out means reads out segment data from said segment data memory means in accordance with said phonetic transcription information with prosody information;

said synthesizing means synthesizes speech sounds by utilizing said phonetic transcription information with prosody information and said segment data;

said segment data memory means stores voicing source characteristics and vocal tract transmission characteristics information; and said synthesizing means synthesizes speech sounds by generating a voicing source wave form having a period in accordance with said prosody information and having characteristics in accordance with said sound characteristics and by filter processing said voicing source wave form in accordance with said vocal tract transmission characteristics information.

Still yet another aspect of the present invention is a speech sound communication system comprising:

a transmission part having a text input means and a first transmission means;

a repeater part having a first reception means, a language analysis means, a prosody generation means and a second transmission means; and a reception part having a second reception means, an segment data memory means, an segment read-out means and a synthesizing means;

wherein, said text input means inputs text information;

said first transmission means transmits said text information to a first communication path;

said first reception means receives said text information from said first communication path;

said language analysis means converts said text information into phonetic transcription information;

said prosody generation means converts said phonetic transcription information into phonetic transcription information with prosody information;

said second transmission part transmits said phonetic transcription information with prosody information into a second communication path;

said second reception part receives said phonetic transcription information with prosody information from said second communication path;

said segment read-out means reads out segment data from said segment data memory means in accordance with said phonetic transcription information with prosody information;

said synthesizing means synthesizes speech sounds by utilizing said phonetic transcription information with prosody information and said segment data;

said segment data memory means stores voicing source characteristics and vocal tract transmission characteristics information; and said synthesizing part synthesizes speech sounds by generating a voicing source wave form having a period in accordance with said prosody information and having characteristics in accordance with said voicing source characteristics and by filter processing said voicing source wave form in accordance with said vocal tract transmission characteristics information.

A further aspect of the present invention is a speech sound communications system comprising a transmission part having a text input means, a language analysis means and a first transmission means, a repeater part having a first reception means, prosody generation means and second transmission means and a reception part having a second reception means, an segment data memory means, an segment read-out means and a synthesizing means, wherein, said text input means inputs text information;

said language analysis means converts said text information into phonetic transcription information;

said first transmission means transmits said phonetic transcription information into a first communication path;

said first reception means receives phonetic transcription information from said first communication path;

said prosody generation means converts said phonetic transcription information into phonetic transcription information with prosody information;

said second transmission means transmits said phonetic transcription information with prosody information to a second communication path;

said second reception means receives said phonetic transcription information with prosody information from said second communication path;

said segment read-out means reads out segment data from said segment data memory means in accordance with said phonetic transcription information with prosody information;

said synthesizing means synthesizes speech sounds by using said phonetic transcription information with prosody information and said segment data;

said segment data memory means stores the voicing source characteristics and the vocal tract transmission characteristics information; and said synthesizing part synthesizes speech sounds by generating a voicing source wave form having a period in accordance with said prosody information and having characteristics in accordance with said voicing source characteristics and by filter processing said voicing source wave form in accordance with said vocal tract transmission characteristics information.

BRIEF DESCRIPTION OF THE DRAWINGS

FIG. 8 shows a schematic view for describing the processing the language analysis part;

FIG. 10 shows a pitch table of the prosody generation part;

FIG. 11 shows a time length table of the prosody generation part;

FIG. 12 shows a schematic view for describing the processing of the prosody generation part;

FIG. 13 shows a schematic view for describing the processing of the prosody transformation part.

DESCRIPTION OF THE NUMERALS

Figure 1:
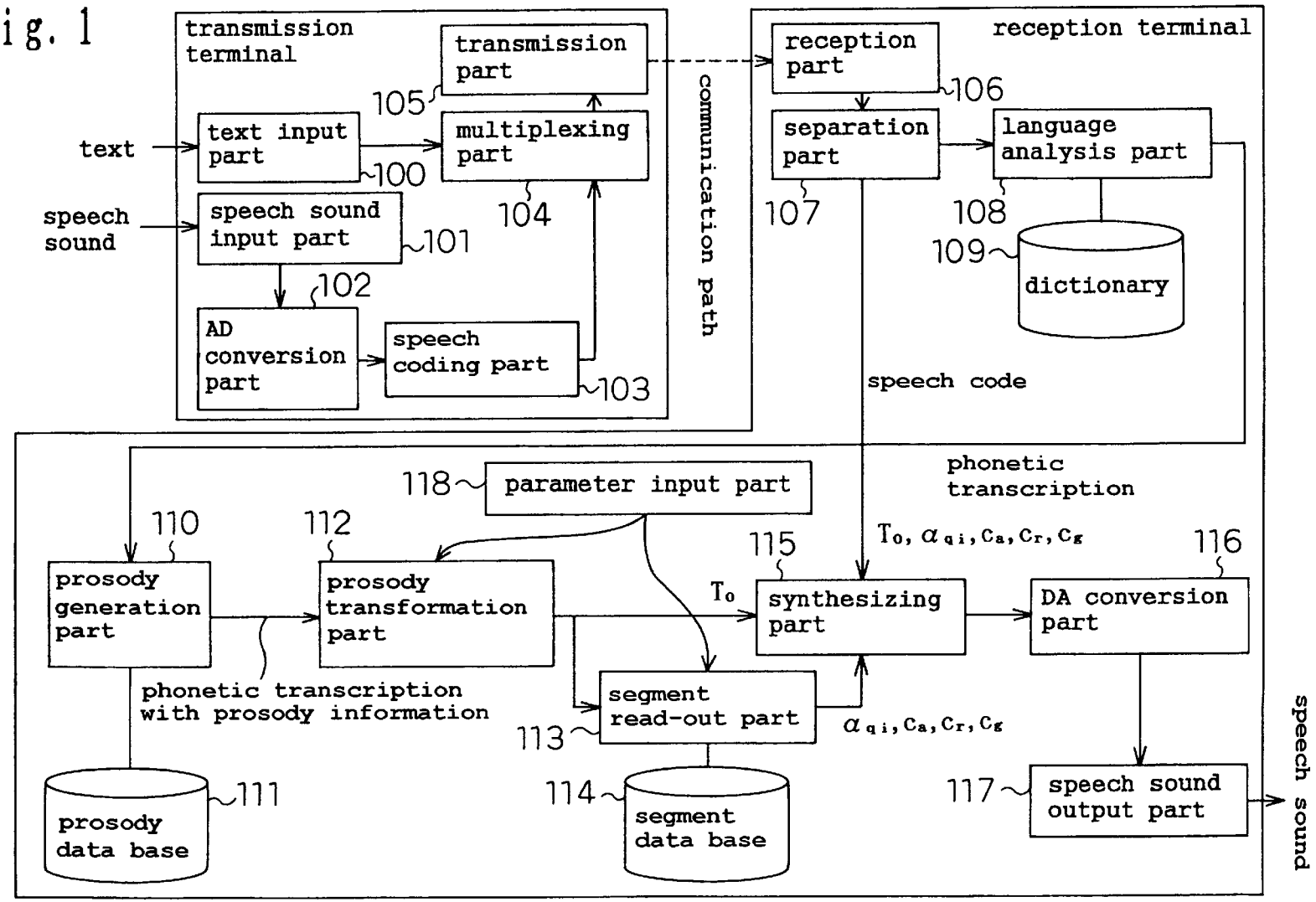
FIG. 1 shows a configuration view of the first embodiment of the speech sound communication system according to the present invention.

100 text input part
101 speech sound input part
102 AD conversion part
103 speech coding part
104 multiplexing part
104-*a* multiplexing part
104-*b* multiplexing part
105 transmission part
105-*a* transmission part
105-*b* transmission part
106 reception part
106-*a* reception part
106-*b* reception part
107 separation part
107-*a* separation part
107-*b* separation part
108 language analysis part
109 dictionary
110 prosody generation part
111 prosody data base
112 prosody transformation part
113 segment read-out part
113-1 segment selection part
113-2 data read-out part
114 segment data base
115 synthesizing part
115-1 adaptive code book
115-2 noise code book
115-3 gain code book
115-4 synthesizing filter
116 DA conversion-part
117 speech sound output part
200 LPC analysis part
201 LPC parameter quantization part
202 synthesizing filter
203 adaptive code book
204 noise code book
205 gain code book
206 auditory weighting filter
207 distortion calculation part
208 adaptive code book
209 noise code book
210 gain code book
211 synthesizing filter

DESCRIPTION OF THE PREFERRED EMBODIMENTS

The embodiments of the present invention are described in reference to the drawings in the following

Embodiment 1

FIG. 1 shows the first embodiment of a speech sound communication system according to the present invention. The speech sound communication system comprises a transmission terminal and a reception terminal, which are connected by a communication path. There are cases where the transmission path contains a repeater including an exchange or the like.

The transmission terminal is provided with a text inputting part 100 of which the output is connected to a multiplexing part 104. A speech sound inputting part 101 is also provided, of which the output is connected to the multiplexing part 104 via an AD converting part 102 and a speech coding part 103. The output of the multiplexing part 104 is connected to a transmission part 105.

The reception terminal is provided with a reception part 106, of which the output is connected to a separation part 107. The output of the separation part 107 is connected to a language analysis part 108 and a synthesis part 115. A dictionary 109 is connected to the language analysis part 108. The output of the language analysis part 108 is connected to a prosody generation part 110.

A prosody data base 111 is connected to the prosody generation part 110. The output of the prosody generation part 110 is connected to the prosody transformation part 112 of which the output is connected to an segment read-out part 113. An segment data base 114 is connected to the segment read-out part 113.

The outputs of both the prosody transformation part 112 and the segment read-out part 113 are connected to the synthesis part 115. The output of the synthesis part 115 is connected to the speech sound outputting part 117 via a DA conversion part 116. A parameter inputting part 118 is also provided, which is connected to the prosody transformation part 112 and the segment read-out part 113.

The operation of the speech sound communication system configured in this way is described in the following. First the operation on the transmission terminal end is described.

The speech coding part 103 analyses speech sounds in the same way as the prior art so as to code the information of the LSP coefficient $\alpha_{qi}$, the pitch period $T_0$, the adaptive code number $c_a$, the noise code number $c_r$, and the gain code number $c_g$ to be outputted to the multiplexing part 104 as a speech code series.

The text inputting part 100 inputs the text. information inputted from a keyboard or the like by the user as the desired text, which is converted into a desired form if necessary to be outputted from the multiplexing part 104. The multiplexing part 104 multiplexes the speech code series and the text information according to the time division so as to be rearranged into a sequence of data series to be transmitted on the communication path via the transmission part 105.

Such a multiplexing method has become possible by means of a data communication method used in a short message service or the like of a portable telephone generally used at present.

Next, the operation on the reception terminal end is described. The reception part 106 receives the above described data series from the communication path to be outputted to the separation part 107. The separation part 107 separates the data series into a speech code series and text information so that the speech code series is outputted to the synthesis part 115 and the text information is outputted to the language analysis part 108, respectively.

The speech code series is converted into a speech sound signal at the synthesis part 115 through the same process as the prior art to be outputted as, a speech sound via the DA conversion part 116 and the speech sound outputting part 117.

On the other hand, the text information is converted into phonetic transcription information which is information for pronounciation, accenting or the like, by utilizing the dictionary 109 or the like in the language analysis part 108 and is inputted to the prosody generation part 110. The prosody generation part 110 adds prosody information which relates to timing for each phoneme, pitch for each phoneme, amplitude for each phoneme in reference to the prosody data base 111 by using mainly accent information and pronounciation information if necessary to be converted to phonetic transcription information with prosody information.

From the phonetic transcription information with prosody information the prosody information is transformed if necessary by the prosody transformation part 112. For example, the prosody information is transformed according to parameters such as speech speed, high pitch or low pitch or the like set by the user accordingly as desired. The speech speed is changed by transforming timing information for each phoneme and high pitch or low pitch are changed by transforming pitch information for each phoneme. Such settings are established by the user accordingly as desired at the parameter inputting part 118.

The phonetic transcription information with prosody information which has its prosody transformed by the prosody transformation part 112 is divided into the pitch period information $T_0$ and the remaining information, and $T_0$ is inputted to the synthesis part 115. The remaining information is inputted to the segment read-out part 113. The segment read-out part 113 reads out the proper segments from the segment data base 114 by using the information received from the prosody transformation part 112 and outputs the LSP parameter $\alpha_{qi}$, the adaptive code number $c_a$, the noise code number $c_r$ and the gain code number $c_g$ memorized as data of the segments to the synthesis part 115.

The synthesis part 115 synthesizes speech sounds from those pieces of information $T_0$, $\alpha_{qi}$, $c_a$, $c_r$ and $c_g$ to be outputted as speech sound via the DA conversion part and the speech sound outputting part 117.

[Operation of the Language Analysis Part]

Next, the operation of the language analysis part in the above described first embodiment is described.

FIG. 8 depicts the manner of the processing of the language analysis part 108. FIG. 8(*a*) shows an example of Japanese, FIG. 8(*b*) shows an example of English and FIG. 8(*c*) shows an example of Chinese. The example of Japanese in FIG. 8(*a*) is described in the following.

The upper box of FIG. 8(*a*) shows a text of the input. The input text is, "It's fine today." This text is converted ultimately to phonetic transcription (phonetic symbols, accent information etc.) in the lower box via mode morph analysis, syntactic analysis or the like utilizing the dictionary 109. "Kyo" or "o" depict a pronunciation of one mora (one syllable unit) of Japanese, "," represents a pause and "/" represents a separation of an accent phrase. "'" added to the phonetic symbol represents an accent core.

In the case of English in FIG. 8(*b*), the processing result describes phoneme symbols as "ih" or "t", the syllable border as "-", and the primary stress and secondary stress as "1" and "2". In the case of Chinese in FIG. 8(*c*) "jin" or "tian" represent pinyin code which is are phonetic symbols of syllable units and the numerals added to each syllable symbol represent the tone information.

Those become the information for synthesizing speech sound with a natural intonation in each language.

[Operations from Prosody Generation to Synthesis]

Next, the operations from prosody generation to synthesis are described.

Figure 9:
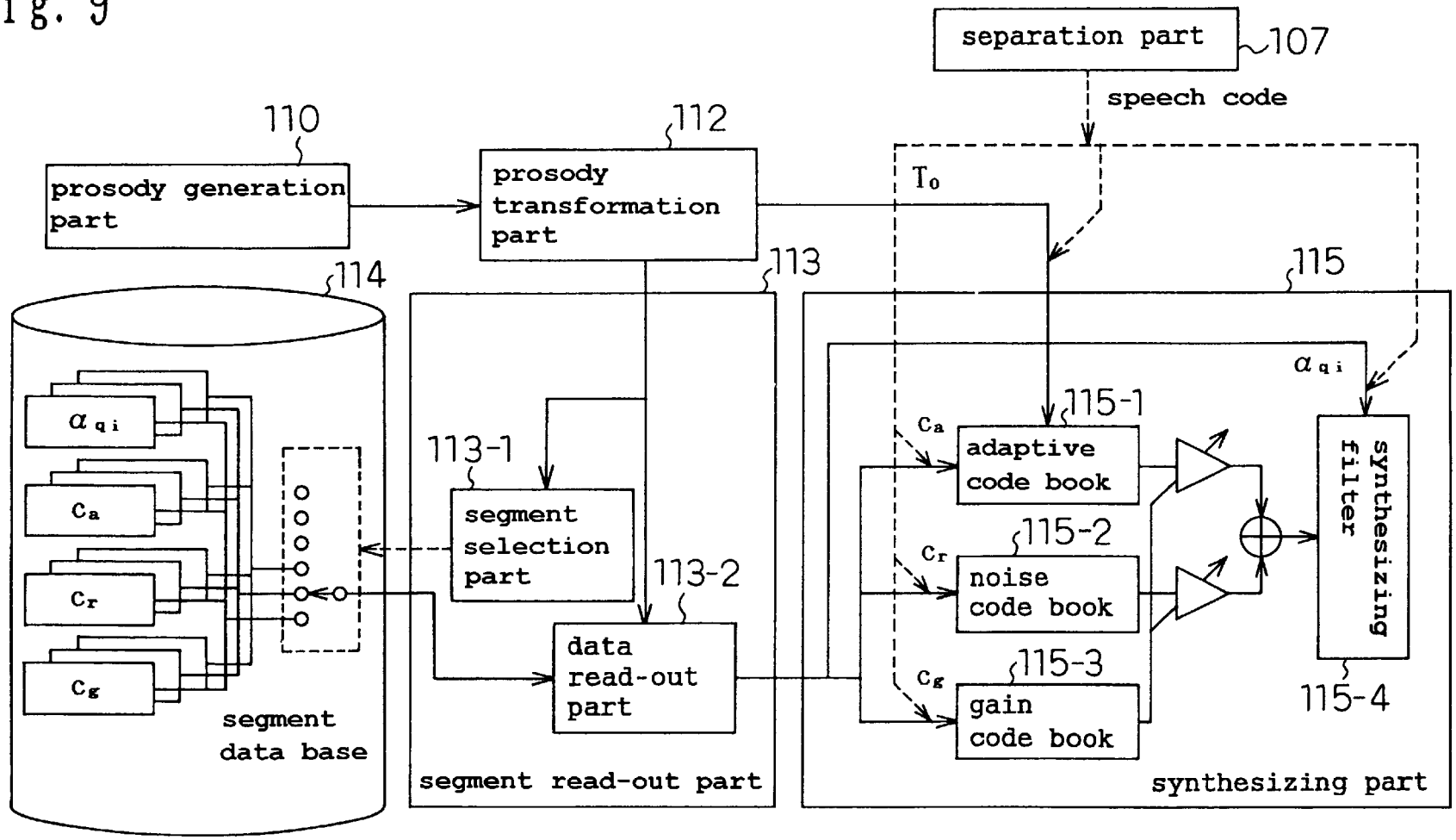
FIG. 9 shows a configuration view in detail of the prosody generation part, the prosody transformation part, and the synthesizing part and surrounding areas.

FIG. 9 shows a prosody generation part 110, prosody transformation part 112, an segment read-out part 113, a synthesizing part 115 and the configurations around them. As shown by a broken line, speech sound codes are inputted from the separation part 107 to the synthesizing part 115, which is the normal operation for speech sound decoding.

On the other hand as shown by a solid line, the data are inputted from the prosody transformation part 112 and the segment read-out part 113, which is the operation in the case where speech sound synthesis is carried out using the text.

This operation of speech sound synthesis using the text is described in the following.

The segment data base 114 stores segment data that has been CELP coded. Phoneme, mora, syllable and the like are generally used for the unit of the segment. The coded data are stored as an LSP coefficient $\alpha_{qi}$, an adaptive code number $c_a$, a noise code number $c_r$, a gain code number $c_g$, and the value of each of them is arranged for each frame period.

The segment read-out part 113 is provided with the segment selection part 113-1, which designates one of the segments stored in the segment data base 114 utilizing the phonetic transcription information among the phonetic transcription information together with the prosody information transmitted from the prosody transformation part 112.

Next, the data read-out part 113-2 reads out the data of the segments designated from the segment data base 114 to be transmitted to the synthesizing part. At this time, the time of the segment data is expanded or reduced utilizing the timing information included in the phonetic transcription information together with the prosody information transmitted from the prosody transformation part 112.

One piece of segment data is represented by a time series as shown in Equation 1.

$$V_m=\{v_{m0}, v_{m1}, \ldots v_{mk}\} \quad (1)$$

Where m is an segment number, and k is a frame number for each segment. $V_m$ for each frame is the CELP data as shown in Equation 2.

$$v_m=\{\alpha_{q0}, \ldots, \alpha_{qn}, c_a, c_r, c_g\} \quad (2)$$

The data read-out part 113-2 calculates out the necessary time length from the timing information and converts it to the frame number k'. In the case of k=k', that is to say the time length of the segment and the necessary time length are equal, the information may be read out one piece at a time in the order of $v_{mo}$, $v_{m1}$, $v_{m2}$. In the case of k>k', that is to say the time length of the segment is desired to be used in reduced form, $v_{mo}$, $v_{m2}$, $v_{m4}$, are properly scanned. In the case of k<k', that is to say the time length of the segment is desired to be used in an expanded form, the frame data are repeated if necessary in such a form as $v_{m0}$, $v_{m0}$, $v_{m1}$, $v_{m2}$, $v_{m2}$.

The data generated in this way are inputted into the synthesizing part 115. $c_a$ is inputted to the adaptive code book 115-1, $c_g$ is inputted to the noise code book, $c_g$ is inputted to the gain code book and $\alpha_{qi}$ is inputted to the synthesizing filter, respectively.

Here, $T_0$ is inputted from the prosody transformation part 112.

Since the adaptive code book 115-1 repeatedly generates the voicing source wave form shown by $c_a$ with a period of $T_0$, the spectrum characteristics follow the segment so that the voicing source wave form is generated with a pitch in accordance with the output from the prosody transformation part 112. The rest is according to the same operation as the normal speech decoding.

[Operations of the Prosody Generation Part and the Prosody Transformation Part]

Next, the operations of the prosody generation part 110 and the prosody transformation part 112 are described in detail.

Phonetic transcription information is inputted into the prosody generation part 110.

In the example shown in FIG. 8(*a*) "kyo' owa, i' i/te' Nkidesu." is the input. The Japanese prosody is described with the unit called an accent phrase. The accent phrase is separated by "," or "/". In the case of this example, three accent phrases exist. One or zero accent cores exist in the accent phrase, and the accent type is defined depending on the place of the accent core. In the case that the accent core is in the leading mora, it is called type 1 and whenever it moves back by one it is called type 2, type 3 or the like. In the case that there exists no accent core it is specifically called type 0. The accent phrases are classified based on the numbers of moras included in the accent type and the accent phrase. In the case of this example they are 3 moras of type 1, 2 moras of type 1 and 5 moras of type 1 from the lead.

The value of the pitch for each mora is registered with the prosody data base 111 in accordance with the number of moras in the accent phrase and the accent type. FIG. 10 represents the manner where the value of the pitch is registered in the form of frequency (with a unit of Hz) The time length of each mora is registered with the prosody data base 111 corresponding to the number of moras in the accent phrase. FIG. 11 represents that manner. The unit of the time length in FIG. 11 is milliseconds.

Based on such information the prosody generation part 110 carries out the processing as shown in FIG. 12. FIG. 12 represents the input/output data of the prosody generation part 110. The input is the phonetic transcription which is the output of the language processing result in FIG. 8. The outputs are the phonetic transcription, the time length and the pitch. The phonetic transcription is the transcription of each syllable of the input after the accent symbols have been eliminated.

And "," and "." are replaced with a symbol "SIL" representing silence. As for the time length information pieces of 3 moras, 2 moras and 5 moras are taken out of the time length table in FIG. 11 to be used.

For the syllable of SIL a constant of 200 is allocated for this place. As for the pitch information the information pieces of 3 moras of type 1, 2 moras of type 1 and 5 moras of type 1 are taken out of the pitch table in FIG. 10 to be used.

The prosody transformation part 112 transforms those pieces of information according to the information set by the user via the parameter inputting part 118. For example, in order to change the pitch, the value of the frequency of the pitch may be multiplied by a constant $p_f$. In order to change the vocalization rate the value of the time length may be multiplied by a constant $P_d$. In the case of $p_f$=1.2 and $P_d$=0.9, an example of the relationships between the input data of the prosody transformation part 112 and the processing result are shown in FIG. 13. The prosody transformation part 112 outputs the value of $T_0$ for each frame to the adaptive code book 115-1 based on this information. Therefore, the value of pitch frequency determined for each mora is converted to the frequency $F_0$ for each frame using liner interpolation or a spline interpolation, which is converted by Equation 3 utilizing the sampling frequency $F_s$.

$$T_0=F_s/F_0 \quad (3)$$

Figure 14:
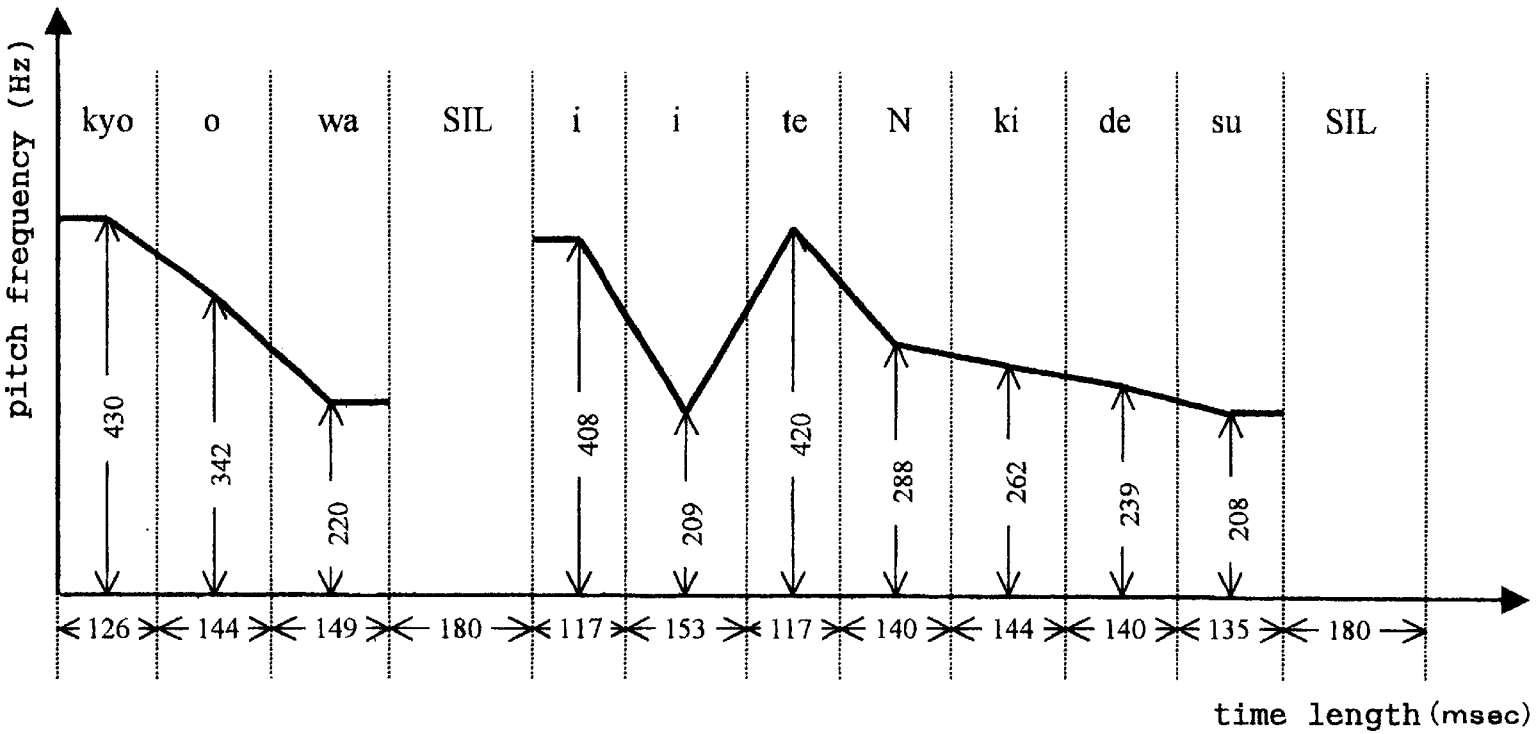
FIG. 14 shows a schematic view for describing a manner where the prosody generation part generates a continuous pitch pattern through interpolation.

FIG. 14 shows the way the pitch frequency F is liner interpolated. In this example, a line is interpolated between 2 moras and the flat frequency is outputted as much as possible by using the closest value at the beginning of the sentence or just before and after SIL.

Though the explanation has been focused mainly on the example of Japanese so far, both English and Chinese may be processed in the same way.

By configuring in this way both the speech sound communication and the text speech sound conversion are realized to make it possible to limit the amount of increase of the hardware scale to the minimum by utilizing the synthesizing part 115, the DA conversion part 116 and the speech sound outputting part 117 within the reception terminal apparatus.

With this configuration, processing is also possible such as the display of text on the display screen of the reception terminal and the transformation of the text to the form suitable for the speech sound synthesis, because the text information is sent to the reception terminal as it is.

And since the prosody generation part 110 and the prosody data base 111 are provided on the reception terminal end, it becomes possible for the user to select from a plurality of prosody patterns as desired and to set different prosodys for each reception terminal apparatus.

Since the prosody transformation part 112 is mounted on the reception terminal end, the user can vary the parameters of the speech sound such as the speech rate and/or the pitch as desired.

In addition, since the segment read-out part 113 and the segment data base 114 are mounted on the reception terminal end, it becomes possible for the user to switch between male and female voices and to switch between speakers or to select speech sounds of different speakers for each apparatus as desired.

Though, in the description of the present embodiment the user inputs an arbitrary text from the keyboard or the like to the text inputting part 100, the text may be read out from memory media such as a hard disc, networks such as the Internet, LAN or from a data base. And it may also make it possible to input the text using the speech sound recognition system instead of the keyboard. Those principles are applied to the embodiments described hereinafter.

Though, in the present embodiment, the pitch and the time length are used in the prosody generation part 110 with reference to the table using the mora numbers and accent forms for each accent phrase, this may be performed in another method. For example, the pitch may be generated as the value of consecutive pitch frequency by using a function in a production model such as a Fujisaki model. The time length may be found statistically as a characteristic amount for each phoneme.

Though, in the present embodiment a basic CELP system is used as an example of a speech coding and decoding system, a variety of improved systems based on this, such as the CS-ACELP system (ITU-T Recommendation G. 729), maybe capable of being applied.

The present invention is able to be applied to any systems where speech sound signals are coded by dividing them into the voicing source and the vocal tract characteristics such as an LPC coefficient and an LSP coefficient.

Embodiment 2

Next, the second embodiment of the speech sound communication system according to the present invention is described.

Figure 2:
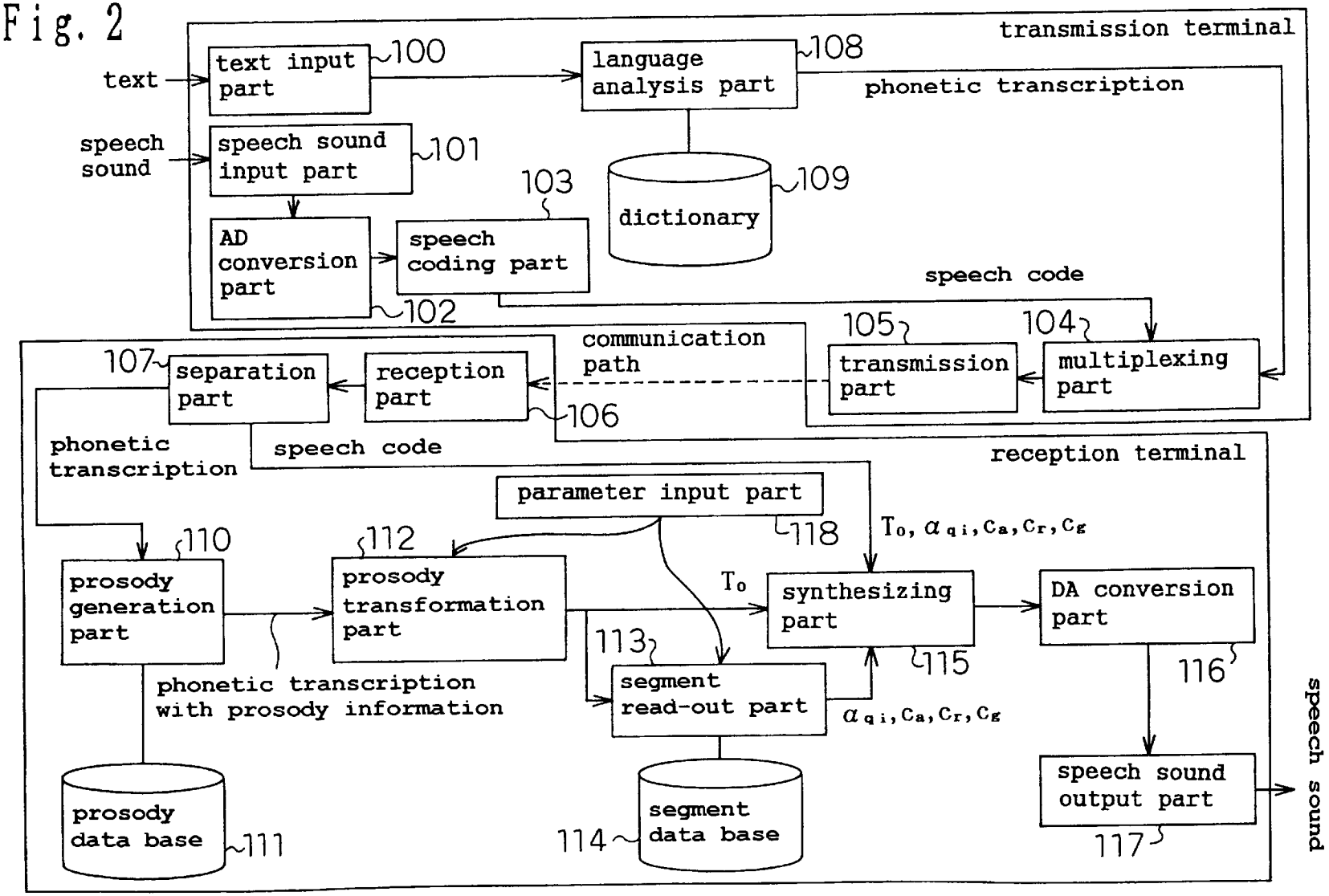
FIG. 2 shows a configuration view of the second embodiment of the speech sound communication system according to the present invention.

FIG. 2 shows the second embodiment of the speech sound communication system according to the present invention. In the same way as the first embodiment, the speech sound communication system comprises the transmission terminal and the reception terminal with a communication path connecting them.

A text inputting part 100 is provided on the transmission terminal of which output is connected to the language analysis part 108. The output of the language analysis part 108 is transmitted to the communication path through the multiplexing part 104 and the transmission part 105.

A reception part 106 is provided on the reception terminal, of which the output is connected to the separation part 107. The output of the separation part 107 is connected to the prosody generation part 110 and the synthesizing part 115. The remaining parts are the same as the first embodiment.

The speech sound communication system configured in this way operates in the same way as the first embodiment.

The differences of the operation of the present embodiment with that of the first embodiment are that the text inputting part 100 outputs the text information directly to the language analysis part 108 instead of the multiplexing part 104, the phonetic transcription information which is the output of the language analysis part 108 is outputted to the multiplexing part 104, the separation part 107 separates the received data series into the speech code series and the phonetic transcription information and the separated phonetic transcription information is inputted into the prosody generation part 110.

By configuring in this way, it is not necessary to mount the language analysis part 108 and the dictionary 109 on the reception terminal end and, therefore, the circuit scale of the reception terminal can be further made smaller. This is an advantage in the case that the reception end is a terminal of a portable type and the transmission side is a large scale apparatus such as a computer server.

It is also possible for the user to select the desired setting from a plurality of prosody patterns or to set different prosodys for each reception terminal apparatus, because the prosody generation part 110 and the prosody data base 111 are provided on the reception terminal end.

The user can also change the speech sound parameters such as the speech rate or the pitch as desired since the prosody transformation part 112 is provided on the reception terminal end.

In addition, since the segment read-out part 113 and the segment data base 114 are mounted on the reception terminal end, it is also possible for the user to switch between male and female voices and to switch between different speakers as desired and to set speech sounds of different speakers for each apparatus.

Embodiment 3

Next, the third embodiment of the speech sound communication system according to the present invention is described.

Figure 3:
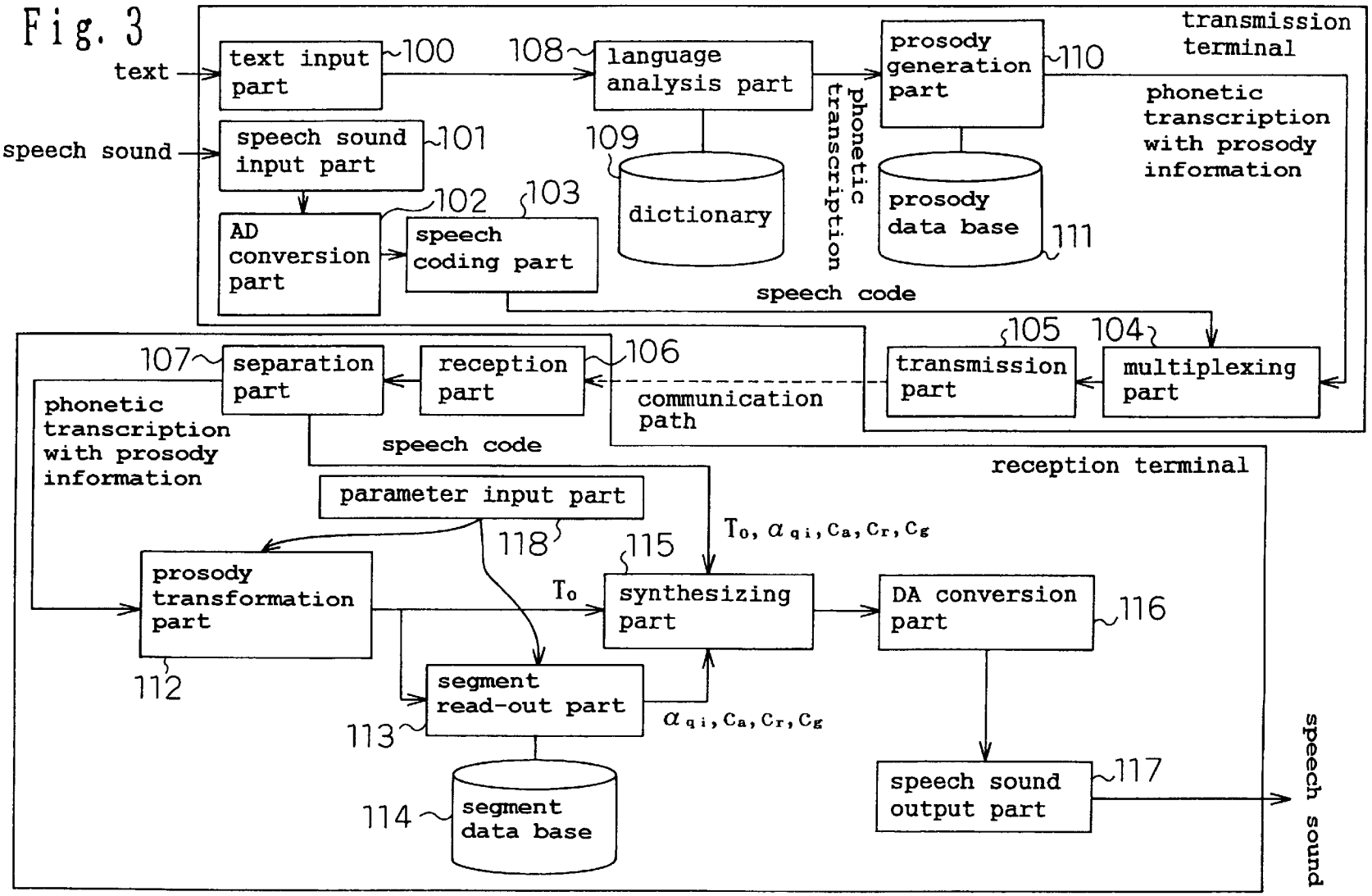
FIG. 3 shows a configuration view of the third embodiment of the speech sound communication system according to the present invention.

FIG. 3 shows the third embodiment of the speech sound communication system according to the present invention. In the same way as the first and the second embodiments, the speech sound communications system comprises the transmission terminal and the reception terminal with a communication path connecting them.

In the present embodiment, unlike in the second embodiment, the prosody generation part 110 and the prosody data base 111 are mounted on the transmission terminal instead of the reception terminal. Accordingly, the phonetic transcription information, which is the output of the language analysis part 108, is directly inputted to the prosody generation part 110, and the phonetic transcription information together with the prosody information, which is the output of the prosody generation part 110 is transmitted to the communication path via the multiplexing part 104 and the transmission part 105 of the transmission terminal.

At the reception terminal end, the data series received via the reception part 106 is separated into the speech code series and the phonetic transcription information together with the prosody information by the separation part 107 so that the speech code series is inputted into the synthesizing part 115 and the phonetic transcription information together with the prosody information is inputted into the prosody transformation part 112.

By being configured in this way it is not necessary to mount the prosody generation part 110 and the prosody data base 111 on the reception terminal's end, therefore, the circuit scale of the reception terminal can further be made smaller. This is still more advantageous that the reception end is a terminal of a portable type and the transmission end is a large scale apparatus such as a computer server.

Since the prosody transformation part 112 is mounted on the reception terminal end, the user can change the speech sound parameters such as the speech rate or the pitch as desired.

In addition, since the segment read-out part 113 and the segment data base 114 are mounted on the reception terminal's side, it also becomes possible for the user to switch between male and female voices and the switch between different speakers as desired and to set the speech sounds of different speakers for each apparatus.

Embodiment 4

Next, the fourth embodiment of the speech sound communication system according to the present invention is described.

Figure 4:
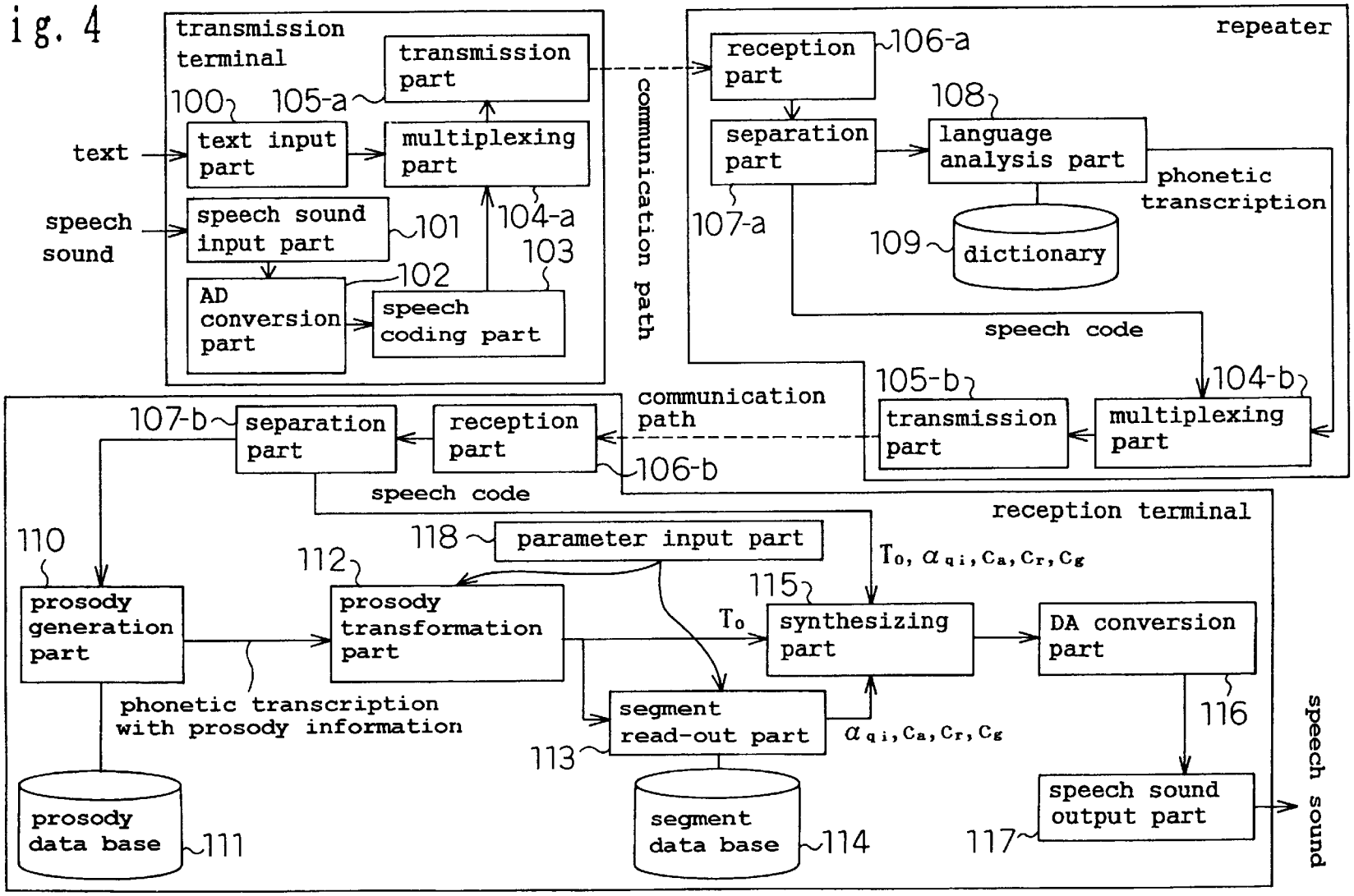
FIG. 4 shows a configuration view of the fourth embodiment of the speech sound communication system according to the present invention.

FIG. 4 shows the fourth embodiment of the speech sound communication system according to the present invention. The speech sound communication system comprises, unlike that of the first, the second and the third embodiments, a repeater in addition to the transmission terminal and the reception terminal with communication paths connecting between them.

The transmission terminal is provided with the text inputting part 100, of which the output is connected to the multiplexing part 104-*a*. It is also provided with the speech sound inputting part 101, of which the output is connected to the multiplexing part 104-*a* via the AD conversion part 102 and the speech coding part 103. The output of the multiplexing part 104-*a* is transmitted to the communication path via the transmission part 105-*a*.

The repeater is provided with the reception part 106-*a* of which the output is connected to the separation part 107-*a*. One output of the separation part 107-*a* is connected to the language analysis part 108 of which the output is connected to the multiplexing pare 104-*b*. The language analysis part 108 is connected with the dictionary 109. The other output of the separation part 107-*a* is connected to the multiplexing part 104-*b*, of which the output is transmitted to the communication part via the transmission part 105-*b*.

The reception terminal is provided with the reception part 106-*b*, of which the output is connected to the separation part 107-*b*. One output of the separation part 107-*b* is connected to the prosody generation part 110. And the prosody generation part 110 is connected with the prosody data base 111. The output of the prosody generation part 110 is connected to the prosody transformation part 112, of which the output is connected to the segment read-out part 113. The segment data base 114 is connected to the segment read-out part 113.

Both outputs of the prosody transformation part 112 and the segment read-out part 113 are connected to the synthesizing part 115. And the output of the synthesizing part 115 is connected to the speech sound outputting part 117 via the DA conversion part 116. It is also provided with the parameter inputting part 118 which is connected to the prosody transformation part 112 and the segment read-out part 113.

The operation of the speech sound communication system configured in this way is the same as that of the first embodiment according to the present invention with respect to the transmission terminal. And with respect to the reception terminal it is the same as that of the third embodiment according to the present invention. The operation in the repeater is as follows.

The reception part 106 receives the above described data series from the communication path to be outputted to the separation part 107. The separation part 107 separates the data series into the speech code series and the text information so that the speech code series is outputted to the multiplexing part 104-*b* and the text information is outputted to the language analysis part 108, respectively. The text information is processed in the same way as in the other embodiments and converted into the phonetic transcription information to be outputted to the multiplexing part 104-*b*. The multiplexing part 104-*b* multiplexes the speech code series and the phonetic transcription information to form a data series to be transmitted to the communication path via the transmission part 105-*b*.

By configuring in this way, it is not necessary to mount the language analysis part 108 and the dictionary 109 on either the transmission terminal or the reception terminal, which makes it possible to make the scale of both circuits smaller. This is advantageous in the case that both the transmission end and the reception end have a terminal apparatus of a portable type.

Since the prosody generation part 110 and the prosody data base 111 are provided on the reception terminal end, it is possible for the user to select the desired setting form a plurality of prosody patterns or to set different prosodies for each reception terminal apparatus.

Since the prosody transformation part 112 is mounted on the reception terminal end, the user can change the speech sound parameters such as vocalization rate and the pitch as desired.

In addition, since the segment read-out part 113 and the segment data base 114 are mounted on the reception terminal's end, it is also possible for the user to switch between male and female voices and to switch between different speakers and to set speech voices of different speakers for each apparatus.

Embodiment 5

Next, the fifth embodiment of the speech sound communication system according to the present invention is described.

Figure 5:
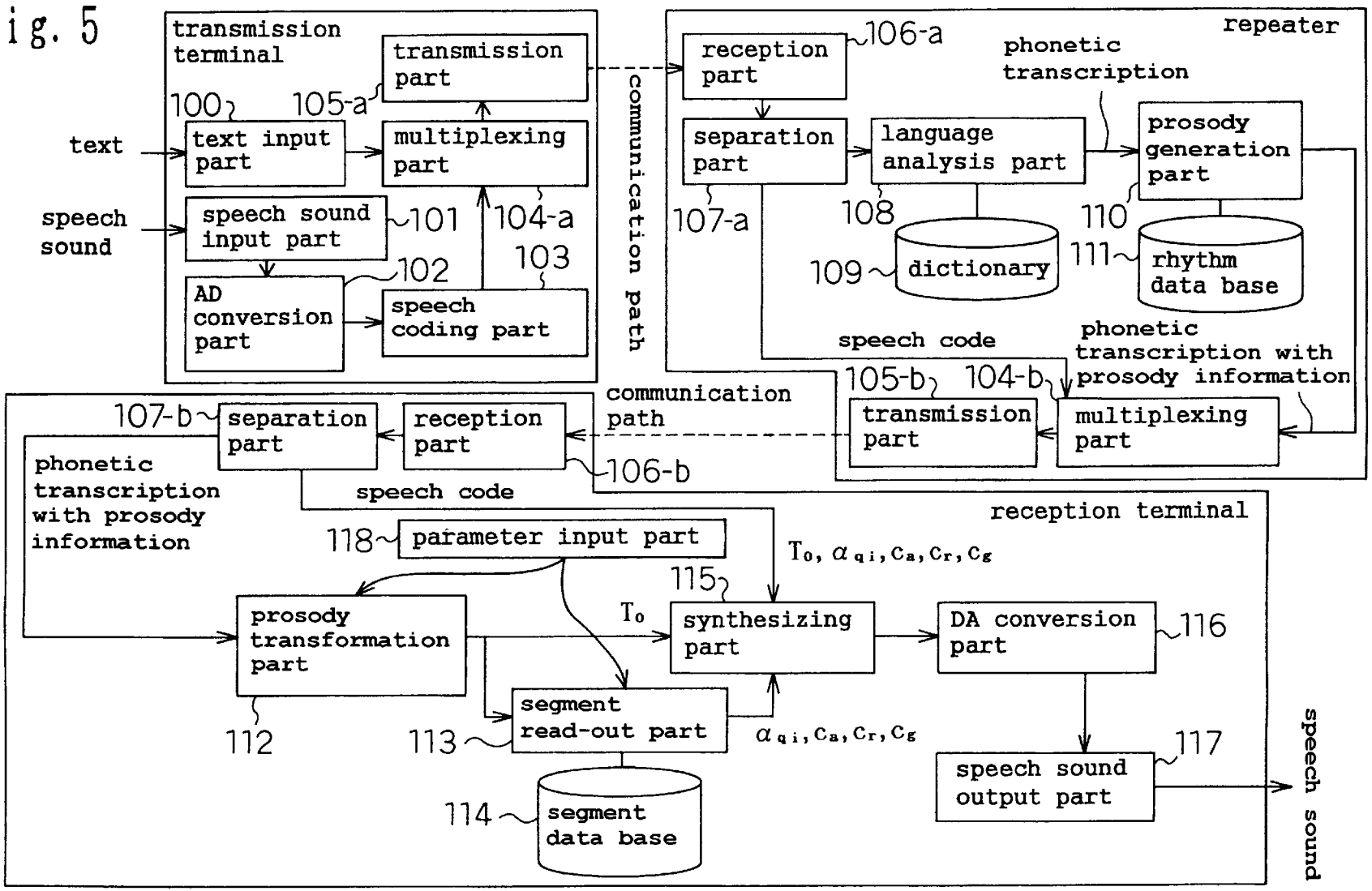
FIG. 5 shows a configuration view of the fifth embodiment of the speech sound communication system according to the present invention.

FIG. 5 shows the fifth embodiment of the speech sound communication system according to the present invention. In the same way as the fourth embodiment the speech sound communication system comprises a transmission terminal, a repeater and a reception terminal with communication paths connecting them.

In the present embodiment, unlike in the fourth embodiment, the prosody generation part 110 and the prosody data base 111 are mounted in the repeater instead of in the reception terminal. Therefore, the phonetic transcription information which is the output of the language analysis part 108 is directly inputted into the prosody generation part 110 and the phonetic transcription information with the prosody information which is the output of the prosody generation part 110 is transmitted to the communication path through the multiplexing part 104-*b* and the transmission part 105-*b*. The transmission terminal operates in the same way as that of the fourth embodiment according to the present invention and the reception terminal operates in the same way as that of the third embodiment according to the present invention.

By configuring in this way, the language analysis part 108 and the dictionary 109 need not be mounted on either the transmission terminal or on the reception terminal, which makes it possible to further reduce the scale of both circuits. This becomes more advantageous in the case that both the transmission end and reception end are terminal apparatuses of a portable type.

Since the prosody transformation part 112 is mounted on the reception terminal end, the user can change the speech sound parameters such as the speech rate and the pitch as desired.

In addition, since the segment read-out part 113 and the segment data base 114 are mounted on the reception terminal end, it is possible for the user to switch between male and female voices and to switch between different speakers and to set speech sounds of different speakers for each apparatus as desired.

Moreover, by utilizing this configuration, it becomes easy to cope with multiple languages. For example, on the transmission end it is set so that a certain language can be inputted and in the repeater a language analysis part and a prosody generation part are prepared to cope with multiple languages. The kinds of languages can be specified by referring to the data base when the transmission terminal is recognized. Or the information with respect to the kinds of languages may be transmitted each time from the transmission terminal.

By utilizing a system for the phonetic transcription such as the IPA (International Phonetic Alphabet) at the output of the language analysis part 108, multiple languages can be transcribed in the same format. In addition, it is possible for the prosody generation part 110 to transcribe the prosody information without depending on the language by utilizing a prosody information description method such as ToBI (Tones and Break Indices, M. E. Beckman and G. M. Ayers, The ToBI Handbook, Tech. Rept. (Ohio State University, Columbus, U.S.A. 1993)) physical amounts such as phoneme time length, pitch frequency, amplitude value.

In this way it is possible to transmit the phonetic transcription information with the prosody information transcribed in a common format among different languages from the repeater to the reception terminal. On the reception terminal end the voicing source wave form can be generated with a proper period and a proper amplitude and proper code numbers are generated according to the phonetic transcription and the prosody information so that the speech sound of any language can be synthesized with a common circuit.

Embodiment 6

Next, the sixth embodiment of the speech sound communication system according to the present invention is described.

Figure 6:
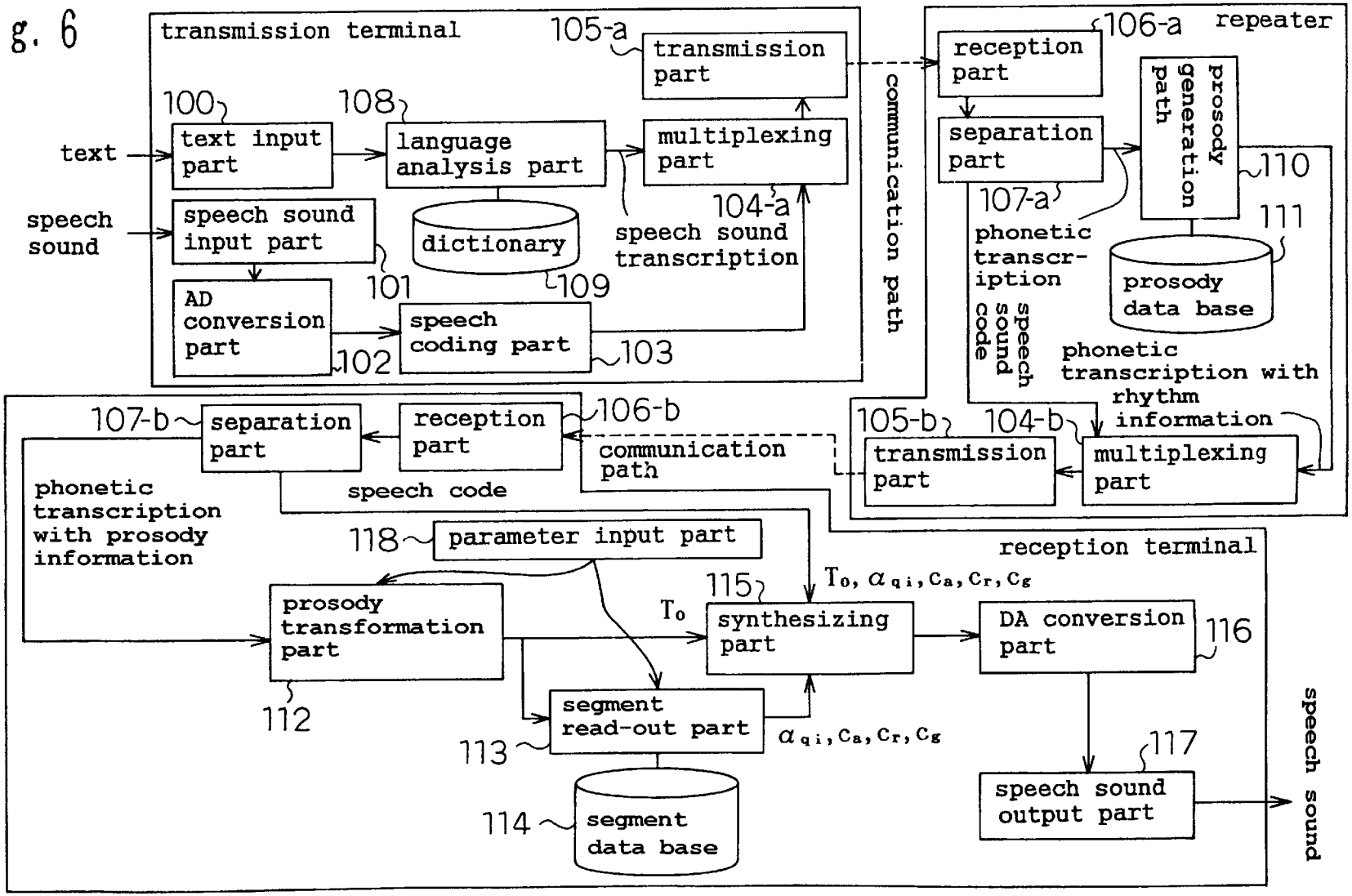
FIG. 6 shows a configuration view of the fifth embodiment of the speech sound communication system according to the present invention.
Figure 7:
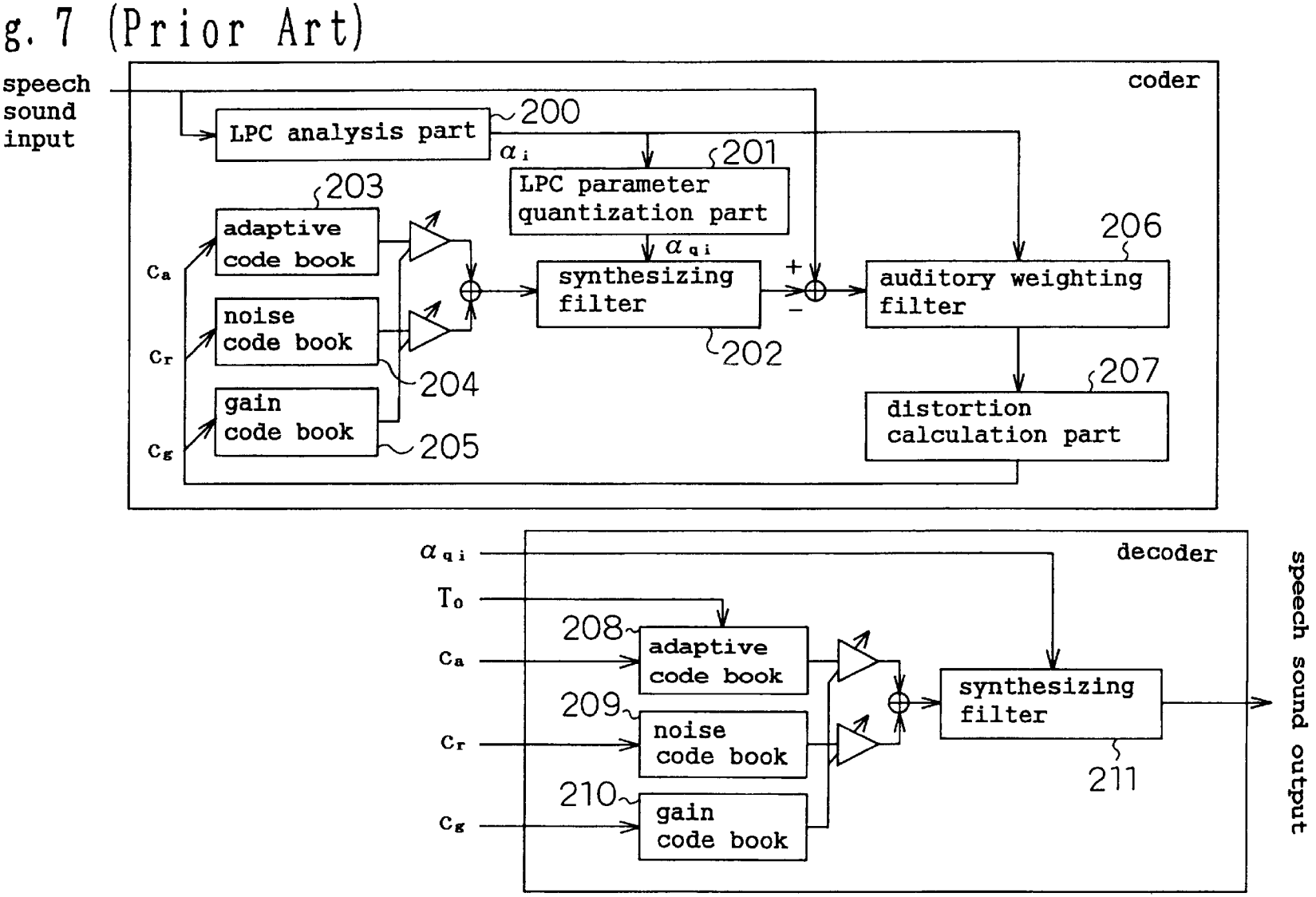
Fig. 7 (Prior Art)
FIG. 7 shows a schematic view for describing a speech coding and decoding system according to a prior art.

FIG. 6 shows the sixth embodiment of the speech sound communication system according to the present invention. In the same way as the fourth and the fifth embodiments the speech sound communication system comprises a transmission terminal, a repeater and a reception terminal with communication parts connecting them to each other.

In the present embodiment, unlike in the fifth embodiment, the language analysis part 108 and the dictionary 109 are mounted on the transmission terminal instead of on the repeater. The transmission terminal operates in the same way as the second embodiment according to the present invention. And the reception terminal operates in the same way as the third embodiment according to the present invention.

In the repeater the data series received from the communication path through the reception part 106-*a* is separated into the phonetic transcription information and the speech code series in the separation part 107-*a*.

The phonetic transcription information is converted into the phonetic transcription information with the prosody information by using prosody data base 111 in prosody generation part 110.

The speech code series is also inputted to the multiplexing part 104-*b*, which is multiplexed with the phonetic transcription information with the prosody information to be one data series that is transmitted to the communication path via the transmission part 105-*b*.

By configuring in this way, the prosody generation part 110 and the prosody data base 111 need not be mounted on the reception terminal in the same way as the fifth embodiment according to the present invention, which makes it possible to reduce the circuit scale.

Since the prosody transformation part 112 is mounted on the reception terminal end, the user can change the speech sound parameters such as the speech rate or the pitch as desired.

In addition, since the segment read-out part 113 and the segment data base 114 are mounted on the reception terminal end, it is possible for the user to switch between male and female voices and to switch between different speakers and to set speech sounds of different speakers for each apparatus as desired.

As described for the fifth embodiment according to the present invention it becomes easy to depend on multiple languages. That is to say, since the reception terminal doesn't have either the language analysis part or the prosody generation part, it is possible to realize hardware which doesn't depend on any languages. On the other hand, the transmission terminal end has a language analysis part to cope with a certain language. In the case that the connection to an arbitrary person is possible in the system through an exchange such as in a portable telephone system, the communication can always be established as far as the reception end not depending on a language. In such circumstances the transmission end can be allowed to have the language dependence.

By configuring as described above, in the communication apparatus with the speech sound decoding part being built in such as in a portable phone, a speech sound rule synthesizing function can be added simply by adding a small amount of software and a table. Among the tables the segment table has a large size but, in the case that wave form segments used in a general rule synthesizing system are utilized, 100 kB or more becomes necessary. On the contrary, in the case that it is formed into a table with code numbers approximately 10 kB are required for configuration. And, of course, the software is also unnecessary in the wave form generation part such as in the rule synthesizing system. Accordingly, all of those functions can be implemented in a single chip.

In this way, by adding a rule synthesizing function through the phonetic symbol text while maintaining the conventional speech sound communication function, the application range is expanded. For example, it is possible to listen to the contents of the latest news information by converting it to speech sound after completing the communication by accessing the server on a portable telephone to download instantly. It is also possible to output with speech sound with the display of characters for the apparatus with a pager function built in.

The speech sound rule synthesizing function can make the pitch or the rate variable by changing the parameters, therefore, it has the advantage that the appropriate pitch height or rate can be selected for comfortable listening in accordance with environmental noise.

In addition, by inputting the text from the communication terminal when a simple text processing function is built in and by transferring this by converting to phonetic symbol text, it also becomes possible to transmit a message with a synthesized speech sound for the recipient.

And it is possible to convert into a synthesized speech sound on the terminal end where the text is inputted, therefore, it can be used for voice memos.

A built-in high level text processing function needs complicated software and a large-scale dictionary, therefore, they can be built into the relay station it becomes possible to realize the same function at low cost.

In addition, in the case that the language processing part and the prosody generation part are built into the transmission terminal or into the relay station it becomes possible to implement a reception terminal which doesn't depend on any languages.

What is claimed is:

1. A speech sound communication system comprising;

a transmission terminal having text input means, speech sound input means, speech coding means, and multiplexing means;

a remote reception terminal having reception means, separation means, language analysis means, prosody generation means, and synthesizing means, wherein, said text input means inputs uncoded text information;

said speech sound input means inputs speech sound signals;

said speech coding means converts said inputted speech sound signals into a speech code series;

said multiplexing means multiplexes said uncoded text information and said speech code series into a multiplexed signal for transmission to the remote reception terminal;

said reception means receives said multiplexed signal;

said separation means separates said multiplexed signal into uncoded text information and said speech code series;

said language analysis means analyses said uncoded text information so that said text information is converted to phonetic transcription information;

said prosody generation means converts said phonetic transcription information into phonetic transcription with prosody information;

said synthesizing means synthesizes a speech sound by utilizing said phonetic transcription information with prosody information and converts said speech code series into a speech sound using a format that is the same as a format for converting the text information into speech sound.

2. A speech sound communication system comprising a transmission terminal having text input means, language analysis means, speech sound input means, speech coding means, multiplexing means, and transmission means;

a remote reception terminal having reception means, separation means, prosody generation means, and synthesizing means, wherein, said text input means inputs text information;

said language analysis means converts said text information into phonetic transcription information;

said speech sound input means inputs speech sound signals;

said speech coding means converts said inputted speech sound signals into a speech code series;

said multiplexing means multiplexes said phonetic transcription information and said speech code series to generate one code series;

said transmission means transmits said generated one code series;

said reception means receives said generated one code series;

said separation means separates said one code series into said phonetic transcription information and said speech code series;

said prosody generation means converts said phonetic transcription information into phonetic transcription information with prosody information; and said synthesizing means converts said speech code series into speech sound using a format that is the same as a format for converting said phonetic transcription information into speech sound.

3. A speech sound communication system comprising a transmission terminal having text input means, language analysis means, prosody generation means, speech input means, speech coding means, multiplexing means, and transmission means;

a remote reception terminal having reception means, separation means, segment data memory means, segment read-out means and synthesizing means, wherein, said text input means inputs text information;

said language analysis means converts said text information into phonetic transcription information;

said prosody generation means converts said phonetic transcription information into phonetic transcription information with prosody information;

said speech input means inputs speech sound signals;

said speech coding means converts said speech sound signals into a speech code series by analyzing pitch, voicing source characteristics and vocal tract transmission characteristics of the signal to be coded;

said multiplexing means multiplexes said phonetic transcription information with prosody information and said speech code series to generate one code series;

said transmission means transmits said generated one code series;

said reception means receives said generated one code series;

said separation means separates said one code series into said phonetic transcription information with prosody information and said speech code series;

said segment read-out means reads out segment data from said segment data memory means in accordance with said phonetic transcription information with prosody information;

said synthesizing means synthesizes a speech sound by utilizing said phonetic transcription information with prosody information and said segment data;

said segment data memory means stores voicing source characteristics and vocal tract transmission characteristics information; and said synthesizing means converts said speech code series into speech sound using a format that is the same as a format for converting said text information into speech sound.

4. A speech sound communication systems comprising:

a transmission terminal having text input means and first transmission means;

a repeater having first reception means, language analysis means and second transmission means; and a reception terminal having second reception means, prosody generation means, segment data memory means, segment read-out means and synthesizing means;

wherein, said text input means inputs text information, the text information being uncoded;

said first transmission means transmits said uncoded text information to a first communication path;

said first reception means receives said uncoded text information from said first communication path;

said language analysis means converts said uncoded text information into phonetic transcription information;

said second transmission means transmits said phonetic transcription information into a second communication path;

said second reception means receives said phonetic transcription information from said second communication path;

said prosody generation means converts said phonetic transcription information into phonetic transcription information with prosody information;

said segment read-out means reads out segment data from said segment data memory means in accordance with said phonetic transcription information with prosody information;

said synthesizing means synthesizes speech sounds by utilizing said phonetic transcription information with prosody information and said segment data;

said segment data memory means stores voicing source characteristics and vocal tract transmission characteristics information; and said synthesizing means synthesizes speech sounds by generating a voicing source wave form having a period in accordance with said prosody information and having characteristics in accordance with said sound characteristics and by filter processing said voicing source wave form in accordance with said vocal tract transmission characteristics information.

5. A speech sound communication system according to claim 4 wherein:

said transmission terminal has speech sound input means, speech coding means and first multiplexing means;

said repeater has first separation means and second multiplexing means; and said reception terminal has second separation means;

said speech sound input means inputs speech sound signals;

said speech coding means converts said speech sound signals into a speech code series by analyzing pitch, voicing source characteristics and vocal tract transmission characteristics of the signals to be coded;

said first multiplexing means multiplexes said uncoded text information and said speech code series to generate a combined signal;

said first separation means separates said combined signal into said uncoded text information and said speech code series;

said second multiplexing means multiplexes said phonetic transcription information and said speech code series to generate one code series;

said second separation means separates the one code series multiplexed by said second multiplexing means into said phonetic transcription information and said speech code series; and said synthesizing means converts said speech code series into speech sound using a format that is the same as a format for converting said uncoded text information into speech sound.

6. A speech sound communication system comprising:

a transmission terminal having text input means and first transmission means;

a repeater having first reception means, language analysis means, prosody generation means and second transmission means; and a reception terminal having second reception means, segment data memory means, segment read-out means and synthesizing means;

wherein, said text input means inputs text information, the text information being uncoded;

said first transmission means transmits said uncoded text information to a ii first communication path;

said first reception means receives said uncoded text information from said first communication path;

said language analysis means converts said uncoded text information into phonetic transcription information;

said prosody generation means converts said phonetic transcription information into phonetic transcription information with prosody information;

said second transmission means transmits said phonetic transcription information with prosody information into a second communication path;

said second reception means receives said phonetic transcription information with prosody information from said second communication path;

said segment read-out means reads out segment data from said segment data memory means in accordance with said phonetic transcription information with prosody information;

said synthesizing means synthesizes speech sounds by utilizing said phonetic transcription information with prosody information and said segment data;

said segment data memory means stores voicing source characteristics and vocal tract transmission characteristics information; and said synthesizing means synthesizes speech sounds by generating a voicing source wave form having a period in accordance with said prosody information and having characteristics in accordance with said voicing source characteristics and by filter processing said voicing source wave form in accordance with said vocal tract transmission characteristics information.

7. A speech sound communication system according to claim 6 wherein:

said transmission terminal has speech sound input means, speech coding means and first multiplexing means, said repeater has first separation means and second multiplexing means, and said reception terminal has second separation means;

said speech sound input means inputs speech sound signals;

said speech coding means converts said speech sound signals into a speech code series by analyzing pitch, voicing source characteristics and vocal tract transmission characteristics of the signal to be coded;

said first multiplexing means multiplexes said uncoded text information and said speech code series to generate a combined signal;

said first separation means separates said combined signal into said uncoded text information and said speech code series;

said second multiplexing means multiplexes said phonetic transcription information with prosody information and said speech code series to generate one code series;

said second separation means separates said one code series multiplexed by said second multiplexing means into said phonetic transcription information with prosody information and said speech code series; and said synthesizing means converts said speech code series into speech sound using a format that is the same as a format for converting said uncoded text information into speech sound.

8. A speech sound communication system comprising a transmission terminal having text input means, language analysis means and first transmission means, a repeater having first reception means, prosody generation means and second transmission means, and a reception terminal having second reception means, segment data memory means, segment read-out means and synthesizing means, wherein, said text input means inputs text information;

said language analysis means converts said text information into phonetic transcription information;

said first transmission means transmits said phonetic transcription information into a first communication path;

said first reception means receives phonetic transcription information from said first communication path;

said prosody generation means converts said phonetic transcription information into phonetic transcription information with prosody information;

said second transmission means transmits said phonetic transcription information with prosody information to a second communication path;

said second reception means receives said phonetic transcription information with prosody information from said second communication path;

said segment read-out means reads out segment data from said segment data memory means in accordance with said phonetic transcription information with prosody information;

said synthesizing means synthesizes speech sounds by using said phonetic transcription information with prosody information and said segment data;

said segment data memory means stores the voicing source characteristics and the vocal tract transmission characteristics information; and said synthesizing means synthesizes speech sounds by generating a voicing source wave form having a period in accordance with said prosody information and having characteristics in accordance with said voicing source characteristics and by filter-processing said voicing source wave form in accordance with said vocal tract transmission characteristics information.

9. A speech sound communication system according to claim 8 characterized in that:

said transmission terminal has speech sound input means, speech coding means and first multiplexing means, said repeater has first separation means and second multiplexing means, and said reception terminal has second separation means;

said speech sound input means speech sound signals;

said speech coding means converts said speech sound signals into a speech code series by analyzing pitch, voicing source characteristics and vocal tract transmission characteristics of the signal to be coded;

said first multiplexing means multiplexes said phonetic transcription information and said speech code series to generate a combined signal;

said first separation means separates said combined signal into said phonetic transcription information and said sound code series;

said second multiplexing means multiplexes said phonetic transcription information with prosody information and said speech code series to generate one code series;

said second separation means separates said one code series multiplexed by said second multiplexing means into said phonetic transcription information with prosody information and said speech code series; and said synthesizing means converts said speech code series into speech sound using a format that is the same as a format for converting said uncoded text information into speech sound.

10. A speech sound communication system according to claims 2, 3, 4, 6 or 8 wherein the user can input an arbitrary text into said text input means.

11. A speech sound communication system according to claims 2, 3, 4, 6 or 8 wherein said text input means carries out input by reading out a text from a memory medium, network like Internet, LAN or a data base.

12. A speech sound communication system according to claims 2, 3, 4, 6 or 8, further comprising a parameter input means and in that the user can input parameter values of speech sounds as desired by said parameter input means and said prosody generation means and said segment read-out means output values modified in accordance with said parameter values.

13. A speech sound communication system according to claims 1, 2, 3, 5, 7 or 9 wherein the user can input an arbitrary text into said text input means.

14. A speech sound communication system according to claims 1, 2, 3, 5, 7 or 9 wherein said text input means carries out input by reading out a text from a memory medium, network like Internet, LAN or a data base.

15. A speech sound communication system according to claims 1, 2, 3, 5, 7 or 9 further comprising said parameter input means and in that the user can input parameter values of speech sounds as desired by said parameter input means and said prosody generation means and said segment read-out means output values modified in accordance with said parameter values.

16. A method of communicating speech from a transmitter to a remote receiver comprising the steps of:

(a) converting speech to a speech input signal at a transmission terminal;

(b) converting text to a text input signal that is uncoded at the transmission terminal;

(c) coding the speech input signal according to a coding format;

(d) multiplexing the coded speech input signal with the uncoded text input signal;

(e) transmitting the multiplexed signal to a remote receiver;

(f) receiving at the remote receiver and separating the multiplexed signal into a coded first received signal related to the speech input signal and a second received signal related to the uncoded text input signal;

(g) converting at the remote receiver the second received signal into phonetic transcription;

(h) coding at the remote receiver the phonetic transcription of step (g) according to the same coding format as in step (c); and (i) decoding at the remote receiver, respectively, (1) the coded first received signal to produce a first speech output signal and (2) the coded phonetic transcription to produce a second speech output signal, wherein the decoding includes a decoding format which is the same for decoding the coded first received signal and for decoding the coded phonetic transcription.

* * * * *

UNITED STATES PATENT AND TRADEMARK OFFICE

CERTIFICATE OF CORRECTION

PATENT NO. : 6,516,298 B1
DATED : February 4, 2003
INVENTOR(S) : Takahiro Kamai et al.

It is certified that error appears in the above-identified patent and that said Letters Patent is hereby corrected as shown below:

Column 24,
Lines 8, 11 and 15, after "claims" add the numeral -- 1 --.

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,516,298 B1
DATED : February 4, 2003
INVENTOR(S) : Takahiro Kamai et al.

It is certified that error appears in the above-identified patent and that said Letters Patent is hereby corrected as shown below:

Column 2,
Line 51, after the first occurrence of "the" delete the ". (period)".

Column 4,
Line 36, delete "spech" and insert -- speech --.

Column 9,
Line 10, after the second occurrence of "text", delete the ". (period)".

Signed and Sealed this

Twenty-ninth Day of June, 2004

JON W. DUDAS
*Acting Director of the United States Patent and Trademark Office*